US005769670A

United States Patent [19]

Abe

[11] Patent Number: 5,769,670

[45] Date of Patent: Jun. 23, 1998

[54] CONNECTOR WITH REAR HOLDER

[75] Inventor: Kimihiro Abe, Shizuoka, Japan

[73] Assignee: Yazaki Corporation, Tokyo, Japan

[21] Appl. No.: 665,860

[22] Filed: Jun. 19, 1996

[30] Foreign Application Priority Data

Jun. 30, 1995 [JP] Japan ..... 7-166109

[51] Int. Cl.[6] ..... H01R 13/436

[52] U.S. Cl. ..... 439/752

[58] Field of Search ..... 439/752, 595

[56] References Cited

U.S. PATENT DOCUMENTS 5,316,504 5/1994 Jinno ..... 439/752

FOREIGN PATENT DOCUMENTS 61-119285 7/1986 Japan .
2-44579 11/1990 Japan .

*Primary Examiner*—Gary F. Paumen
*Attorney, Agent, or Firm*—Morgan, Lewis & Bockius LLP

[57] ABSTRACT

A connector with a rear holder in which connector terminals can be positively mounted in predetermined positions in a connector housing simultaneously when the rear holder is attached to the connector housing. In the connector with the rear holder, a press member is formed on a reverse surface of a rear holder upper plate through hinges, and when the rear holder upper plate is pressed down from an upper side, the press member is pivotally moved toward a direction of insertion of the connector terminals. As a result, the connector terminals can be forced in the insertion direction, and can be retained in the predetermined positions in terminal receiving chambers. At the same time, withdrawal prevention retaining portions, formed at the rear end portion of the press member, are retainingly engaged respectively with completely-retaining portions formed respectively at partition walls separating the terminal receiving chambers from one another, thereby achieving the double retaining of the connector terminals and the positive attachment of the rear holder.

9 Claims, 6 Drawing Sheets

FIG. 1
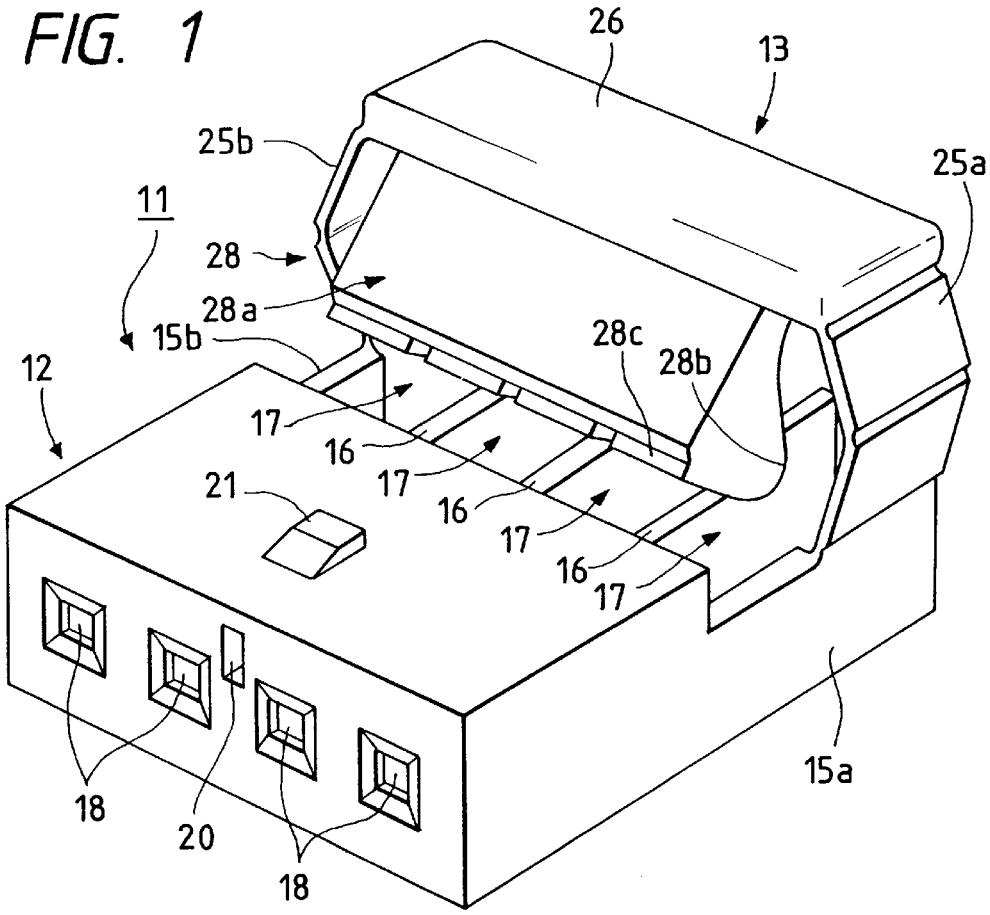
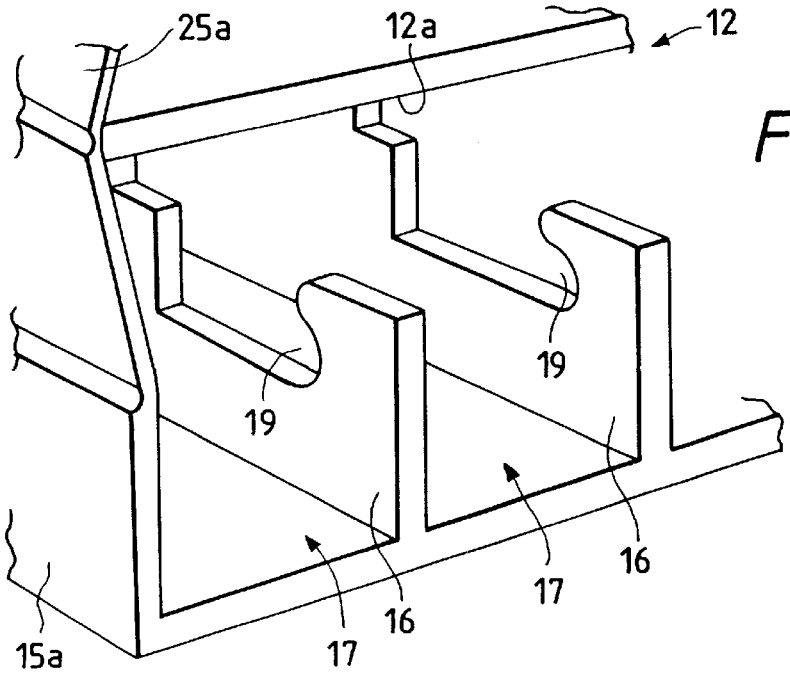
FIG. 2

CONNECTOR WITH REAR HOLDER

BACKGROUND OF THE INVENTION

1. Field of the Invention

This invention relates to a connector with a rear holder in which connector terminals, received in a connector housing, are retained by the rear holder, and more particularly to a construction of attaching the rear holder to the connector housing (hereinafter referred to merely as "housing").as well as a construction of retaining the connector terminals.

2. Background

Various electronic devices, including a CPU, are mounted on a current automobile, and naturally wire harnesses and many connectors are used therein. Connectors of various constructions are used in accordance with the purpose of use, and for example, Japanese Utility Model Unexamined Publication No. 61-119285 discloses a connector having a rear holder which serves as a withdrawal prevention member for retaining connector terminals, received in a housing, in a double manner.

As shown in FIG. 10, the connector X includes the housing A of an integral construction molded of a synthetic resin, and the connector terminals B each having a wire W connector thereto. A plurality of terminal receiving chambers 1 extend through the housing A from its front to its rear side. As shown in FIGS. 11 and 12, a projection 2 for preventing forward withdrawal of the connector terminal is formed at a front end of the terminal receiving chamber 1 while an elastic retaining arm 4, having a retaining projection 4*a* for preventing rearward withdrawal of the connector terminal, is formed at a bottom wall 3.

Openings 5*a* are formed through an upper wall 5, and are open to the terminal receiving chambers 1, respectively. The rear holder 6 is disposed outwardly of the openings 5*a*, and is supported by elastic upstanding piece portions 6*a* formed respectively at opposite ends thereof, the rear holder 6 being formed integrally on the housing through these portions 6*a*. Retaining projections 6*b* are formed on and extend vertically from an inner surface of the rear holder 6. Each retaining projection 6*b* has a chamfered drive portion 6*d* formed at its front side.

The connector terminal B includes an electric connection portion B1 of a tubular construction, and a wire connection portion B2 of a compressive clamping type, and the wire W is compressively clamped to the wire connection portion B2.

For assembling the above connector X, the wire W is connected to the wire connection portion B2 of the connector terminal B, and each wire W is inserted into the associated terminal receiving chamber 1, with the electric connection portion B1 first introduced thereinto, as shown in FIG. 10. As shown in FIG. 11, the retaining projection 4*a* of the elastic retaining arm 4, formed on the bottom of the housing A, is engaged in a retaining hole 7*a*, formed in a bottom plate portion 7 of the electric connection portion B1, thereby effecting the primary retaining.

Then, the rear holder 6 is pressed down to insert the retaining projections 6*b* into the respective openings 5*a* while deforming the elastic upstanding piece portions 6*a* as shown in FIG. 11, so that each retaining projection 6*b* is disposed adjacent to the rear end of the associated electric connection portion B1, thereby effecting the secondary retaining.

In this condition, small projections 6*c*, formed on the end surfaces of the rear holder 6, are engaged respectively with small projections 5*c* formed on an inner surface of a recess formed in the upper wall 5, thereby fixing the rear holder 6 relative to the housing.

If the connector terminal B is in an incompletely-inserted condition as shown in FIG. 12, the drive portion 6*d* engages the rear edge of the electric connection portion B1 to force the connector terminal B forward into its completely-inserted position upon depression of the rear holder 6, so that the retaining projection 6*b* is disposed adjacent to the rear end of the electric connection portion B1, thereby effecting the complete secondary retaining.

In the above connector X, when the connector terminal B is in an incompletely-inserted condition, this connector terminal B is forced forward by the drive portion 6*d*; however, the drive portion 6*d*, formed integrally with the housing A, is made of the synthetic resin while the electric connection portion B1 is made of metal.

Therefore, sometimes, the connector terminal B can not be easily forced forward by pressing the arcuate surface of the drive portion 6*d* against the electric connection portion B1, and in the worst case, the drive portion 6*d* bites into the rear edge of the electric connection portion B1. In such a case, the connector terminal B can not be inserted completely, and therefore this construction is not reliable in preventing the incomplete insertion of the connector terminal B.

SUMMARY OF THE INVENTION

It is an object of this invention to provide a connector with a rear holder in which connector terminals can be positively mounted in a housing simultaneously when the rear holder is attached to the housing.

The above object of the present invention has been achieved by a connector with a rear holder described in the following paragraphs (1) to (6):

(1) A connector with a rear holder including a connector housing having terminal receiving chambers for respectively receiving connector terminals, and the rear holder adapted to be attached to the connector housing to retain the connector terminals in the respective terminal receiving chambers; in which the rear holder includes a rear holder upper plate which is pressed when attaching the rear holder to the connector housing, and a press member formed integrally on a reverse surface of the rear holder upper plate in a suspended manner through hinges.

(2) The connector with the rear holder according to paragraph (1), in which the press member has withdrawal prevention retaining portions retainingly engageable respectively with completely-retaining portions formed respectively at upper portions of partition walls of the connector housing.

(3) The connector with the rear holder according to paragraph (1), in which the rear holder upper plate of the rear holder is integrally connected to a rear end portion of the connector housing through foldable hinges.

(4) The connector with the rear holder according to paragraph (1), in which the press member is suspended in inclined relation to a direction of insertion of the connector terminals.

(5) The connector with the rear holder according to paragraph (1), in which a pair of retaining plates are formed integrally on opposite side edges of the rear holder upper plate, and each of the retaining plates has a plurality of retaining portions retainingly engageable with a rear end portion of the connector housing.

(6) A connector with a rear holder according to paragraph (1), in which the press member includes withdrawal prevention retaining portions formed at a rear end portion thereof, and corresponding respectively to partition walls of the connector housing, a retaining step portion formed at a front end thereof, a vertical surface formed at the front end thereof for forcing the connector terminals into the terminal receiving chambers, said press member adapted to retain the terminal, and a curved surface formed at a lower side thereof for sliding movement over the partition walls.

In the connector of the invention with the rear holder as described in paragraphs (1) and (2), the rear holder includes the rear holder upper plate which is pressed when attaching the rear holder to the connector housing, and the press member formed integrally on the reverse surface of the rear holder upper plate in a suspended manner through the hinges. The press member has the withdrawal prevention retaining portions retainingly engageable respectively with the completely-retaining portions formed respectively at the upper portions of the partition walls of the connector housing.

Therefore, when the rear holder upper plate is pressed or moved toward the housing, the press member is pivotally moved forward about the hinges. As a result of this pivotal movement, the press member forces the connector terminals into predetermined positions in the terminal receiving chambers. At this time, the withdrawal prevention retaining portions of the press member are retainingly engaged respectively with the completely-retaining portions formed respectively at the partition walls separating the terminal receiving chambers from one another. Thus, by pressing the rear holder upper plate, the insertion of the connector terminals into the housing, and the attachment of the rear holder to the housing can be effected at the same time, thereby enhancing the efficiency of the operation.

As described in paragraph (3), the rear holder upper plate of the rear holder is integrally connected to the rear end portion of the connector housing through the foldable hinges. Therefore, the rear holder upper plate, when pressed down from the upper side, is moved toward the housing, with the hinges gradually folded.

Therefore, in accordance with the movement of the rear holder upper plate, the press member slidingly moves over the partition walls in the direction of insertion of the connector terminals, so that the connector terminals can be positively inserted into the predetermined positions in the terminal receiving chambers.

As in paragraph (4), the press member is suspended in inclined relation to the direction of insertion of the connector terminals. Therefore, as the rear holder upper plate is pressed down, the press member positively slides over the partition walls in the direction of insertion of the connector terminals.

As in paragraph (5), the pair of retaining plates are formed integrally on the opposite side edges of the rear holder upper plate, and each of the retaining plates has the plurality of retaining portions retainingly engageable with the rear end portion of the connector housing. Therefore, with the rear holder held in the provisionally-retained condition, the predetermined number of connector terminals can be inserted respectively into the terminal receiving chambers. Thereafter, when pressing down the rear holder upper plate from the upper side, the press member positively slides over the partition walls in the direction of insertion of the connector terminals.

As in paragraph (6), the press member includes the withdrawal prevention retaining portions formed at the rear end portion thereof, and corresponding respectively to the partition walls of the connector housing, the retaining step portion formed at the front end thereof, the vertical surface formed at the front end thereof for forcing the connector terminals, and the curved surface formed at the lower side thereof for sliding movement over the partition walls. Because of the provision of the curved surface, the press member can smoothly slide over the partition walls, and the vertical surface can abut against rear edges of electric connection portions of the connector terminals, thereby positively inserting the connector terminals, and the withdrawal prevention retaining portions can be retainingly engaged respectively with the completely-retaining portions formed respectively at the partition walls, thereby positively preventing rearward withdrawal of the connector terminals.

BRIEF DESCRIPTION OF THE DRAWINGS

FIG. 1 is a perspective view of a connector with a rear holder according to a first embodiment of the invention;

FIG. 2 is a perspective view of an important portion of the connector of FIG. 1, showing the construction of a housing;

DETAILED DESCRIPTION OF THE PREFERRED EMBODIMENTS

Figure 3:
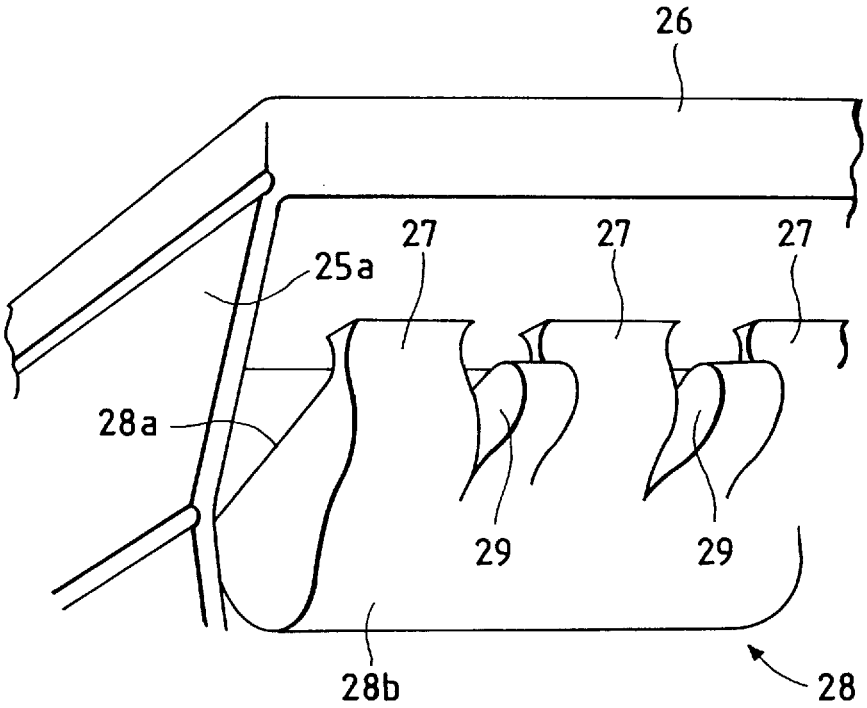
FIG. 3 is a perspective view of an important portion of the connector of FIG. 1, showing the construction of the rear holder.
Figure 5:
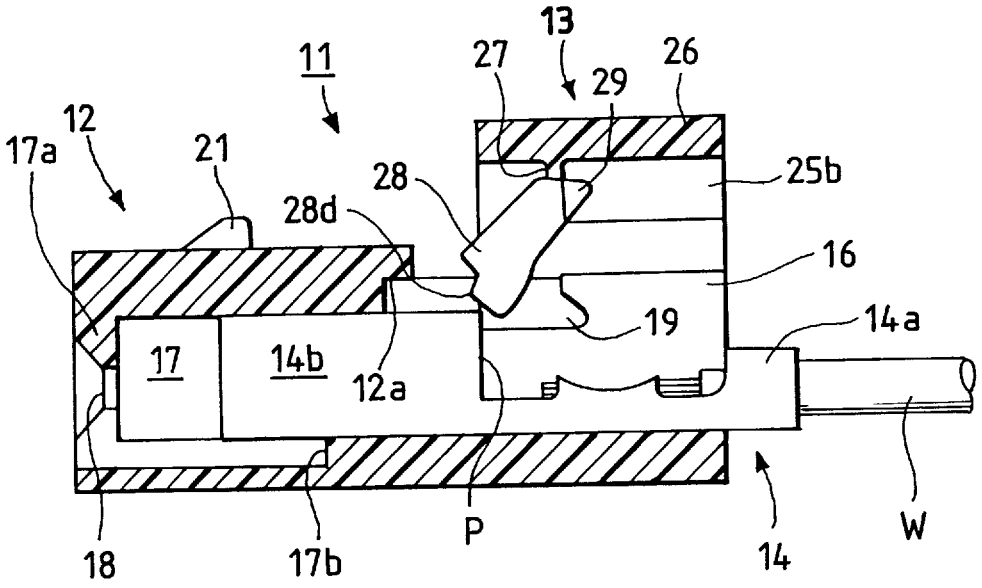
FIG. 5 is view showing a condition in which the connector terminal is forced forward.
Figure 6:
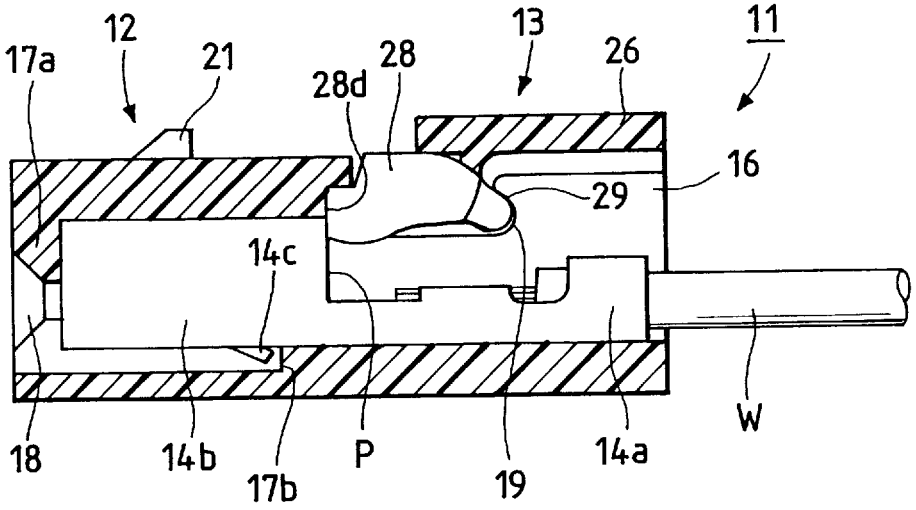
FIG. 6 is a view showing the rear holder in a completely-retained condition.

A first embodiment of a connector of the invention with a rear holder will be described with reference to FIGS. 1 to 6. FIG. 1 is a perspective view of the connector of this embodiment with the rear holder, FIG. 2 is an enlarged, perspective view of an important portion of the connector of FIG. 1, showing the construction of terminal receiving chambers, FIG. 3 is an enlarged, perspective view of an important portion of the connector of FIG. 1, showing the construction of the rear holder, and FIGS. 4 to 6 are views showing the process of insertion of a connector terminal in the connector of FIG. 1.

Figure 4:
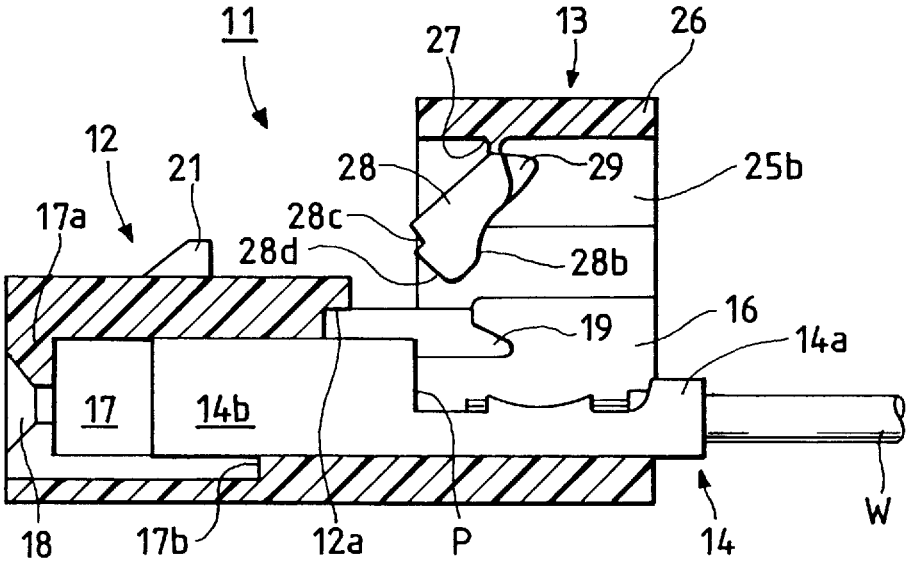
FIG. 4 is a view showing a connector terminal mounted in the connector of FIG. 1.

As shown in FIG. 1, the connector 11 of this embodiment includes a housing 12 and the rear holder 13 which are molded of a synthetic resin in integral relation to each other, and further includes connector terminals 14 (see FIG. 4)

which are received in the housing 12, and are retained in a double manner by the housing 12 and the rear holder 13.

In this embodiment, four terminal receiving chambers 17 are formed in the housing 12 by opposite side plates 15*a* and 15*b* and three partition walls 16. The number of the terminal receiving chambers 17 is not limited to four as in this embodiment, but can be suitably changed. Formed at the front end of each terminal receiving chamber 17 is a terminal insertion port 18 for inserting a mating connector terminal therethrough, and a rear end portion of each terminal receiving chamber 17 is open at its upper side.

A retaining hole 20 for connecting a mating connector or a mating electronic device is formed in the front surface of the housing 12, and a retaining projection 21 is formed on an upper surface of the housing 12. As shown in FIG. 2, each partition wall 16 is notched at an upper edge thereof at a rear end portion thereof to provide a completely-retaining portion 19.

In this embodiment, hinges 25*a* and 25*b*, forming part of the rear holder 13, are foldably formed integrally respectively on upper edges of the opposite side plates 15*a* and 15*b* at the rear end portion of the housing 12. A plate-like rear holder upper plate 26 extends between the upper ends of the two hinges 25*a* and 25*b* like a bridge.

A press member 28 is obliquely suspended from a lower surface of the rear holder upper plate 26 through hinges 27 as shown in FIG. 3. When the rear holder upper plate 26 is pressed down against the hinges 25*a* and 25*b*, the press member 28 is fitted into the terminal receiving chambers 17 to press or move the connector terminals 14 forwardly. Withdrawal prevention retaining portions 29 are formed at the rear end of the press member 28, and are engageable respectively with the completely-retaining portions 19 to prevent withdrawal of the connector terminals 14 and also to prevent the whole of the rear holder 13 from moving upward.

As shown in FIGS. 1 and 3, the press member 28 has a flat surface 28*a* and a curved surface 28*b*, and the withdrawal prevention retaining portions 29 project rearwardly beyond the curved surface 28*b* adjacent to the hinges 27 formed at the proximal end of the curved surface 28*b*, these retaining portions 29 being spaced at predetermined intervals such that they are in registry with the partition walls 16, respectively.

The assembling of the connector 11 will now be described with reference to FIGS. 4 to 6. A wire W is beforehand connected to a wire connection portion 14*a* of each connector terminal 14, and the connector terminal 14 is inserted into the associated terminal receiving chamber 17, with an electric connection portion 14*b* first introduced thereinto, as shown in FIG. 4. The connector terminal 14 is thus inserted until a rear edge P of the electric connection portion 14*b* is brought near to an upper end surface 12*a* of the housing 12.

Then, the rear holder upper plate 26 is pressed down against the hinges 25*a* and 25*b*, as shown in FIG. 5. As a result, a vertical surface 28*d*, formed on the front side of the press member 28, engages the rear edge P of the electric connection portion 14*b* of each connector terminal. In this condition, when the rear holder upper plate 26 is further pressed down, the whole of the press member 28 is pivotally moved about the hinges 27 from the suspended condition into a horizontal condition. At this time, the press member 28 can smoothly slide over the partition walls 16 because of the curved surface 28*b*. As a result of this pivotal movement, the front end of the press member is moved forward (that is, in the direction of insertion of the connector terminals 14), so that the whole of each connector terminal 14 is forced or moved forward.

At the time when the press member 28 is completely pressed down as shown in FIG. 6, the front end of the electric connection portion. 14*b* of each connector terminal is held against a front wall 17*a* of the associated terminal receiving chamber 17 to communicate with the terminal insertion port 18, so that the mating terminal can be electrically connected to the connector terminal 14. At this time, a resilient retaining piece portion 14*c*, formed at the lower surface of the electric connection portion 14*b*, is retainingly engaged with a step portion 17*b* formed in the bottom of the terminal receiving chamber 17, thereby effecting the primary retaining.

At this time, each withdrawal prevention retaining portion 29 is engaged with the associated completely-retaining portion 19, and a step portion 28*c*, formed in the upper edge of the press member 28 at the front end thereof, is engaged with the step portion 12*a* formed in the edge of the housing 12. Therefore, the hear holder 13 is prevented from upward and rearward movement. Thus, each connector terminal 14 is retained in a secondary manner, and hence is retained in a double manner with the above-mentioned primary retaining and this secondary retaining.

As described above, in the connector 11 of this embodiment, the connector terminals 14, inserted respectively in the terminal receiving chambers 17, can be retained in the respective terminal receiving chambers 17 in a double manner by moving the rear holder upper plate 26.

Therefore, the efficiency of insertion of the connector terminals is enhanced, and the retaining of the connector terminals can be positively effected, thereby enhancing the reliability of the connector. And besides, since the press member 28 of the rear holder 13 is integrally connected to the housing 12 through the hinges 25*a* and 25*b*, it will not deformed, disengaged or caught upon application of an external force, thereby positively effecting the double retaining.

Figure 7:
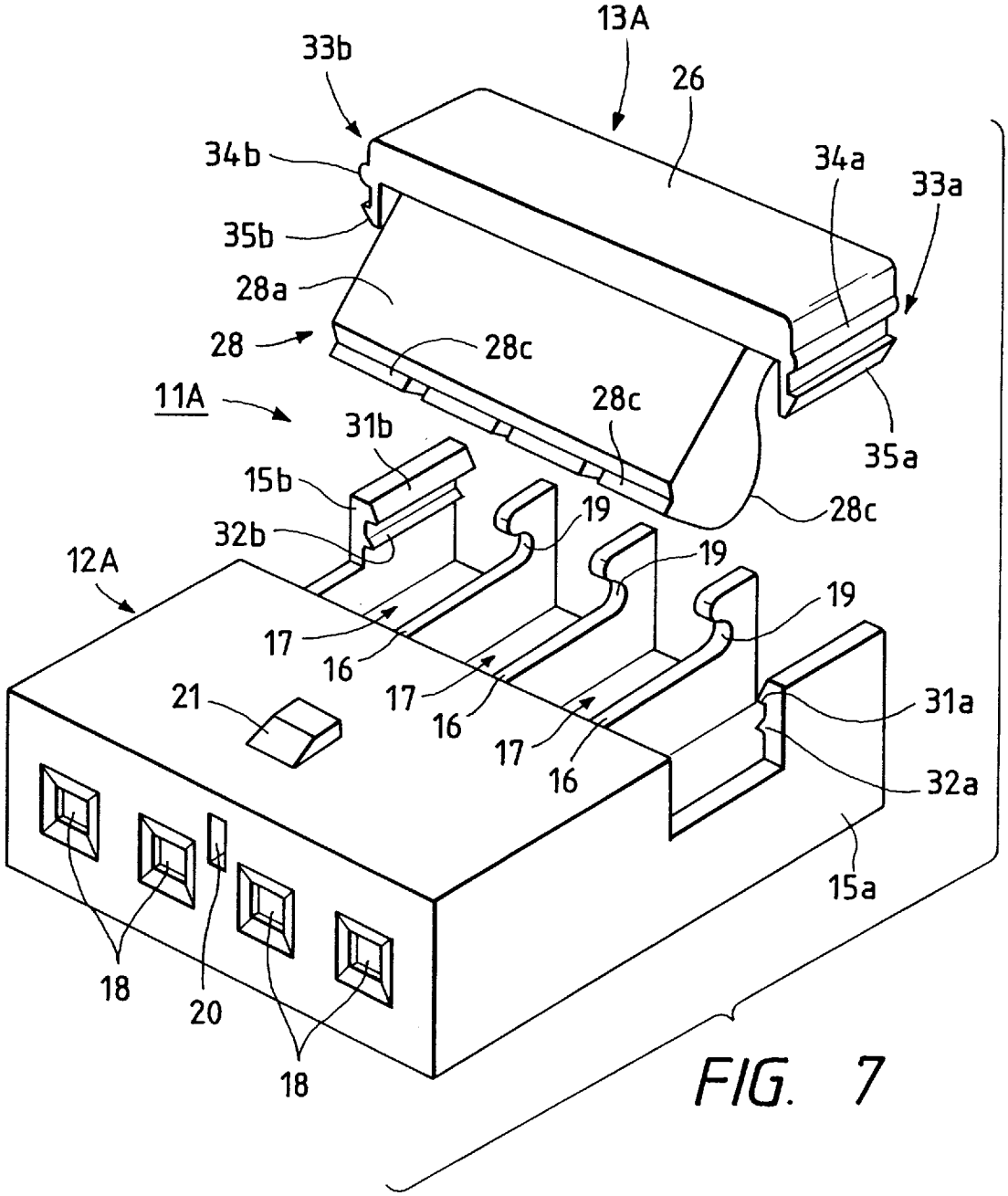
FIG. 7 is a perspective view of a connector with a rear holder according to a second embodiment of the invention.
Figure 8:
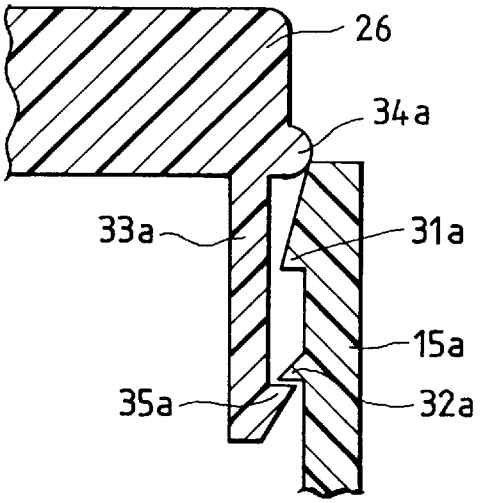
FIG. 8 is a cross-sectional view of a portion of the connector of FIG. 7, showing a condition in which a housing and the rear holder are provisionally retained together.
Figure 9:
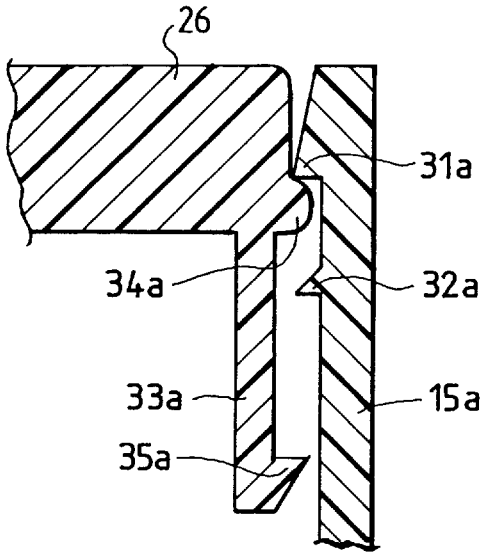
FIG. 9 is a cross-sectional view of a portion of the connector of FIG. 7, showing a condition in which the housing and the rear holder are completely retained together.
Figure 10:
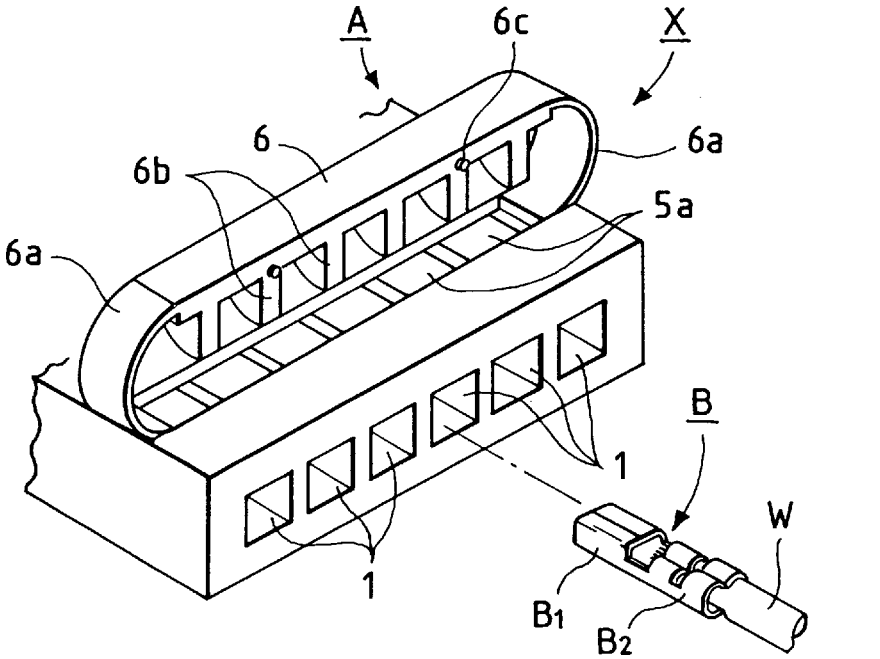
FIG. 10 PRIOR ART
FIG. 10 is a perspective view showing the construction of a conventional connector with a rear holder.
Figure 11:
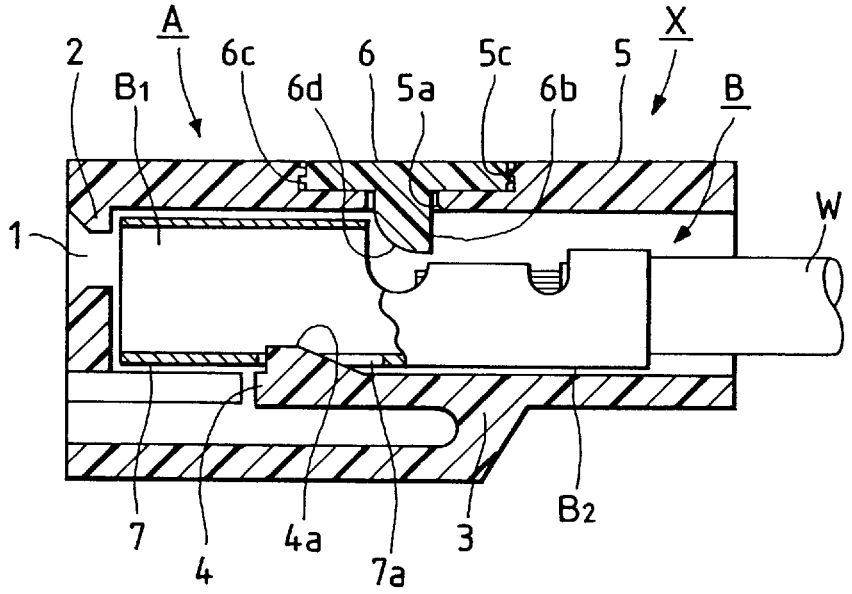
FIG. 11 PRIOR ART
FIG. 11 is a cross-sectional view showing a retained condition of a connector terminal in the connector of FIG. 10.
Figure 12:
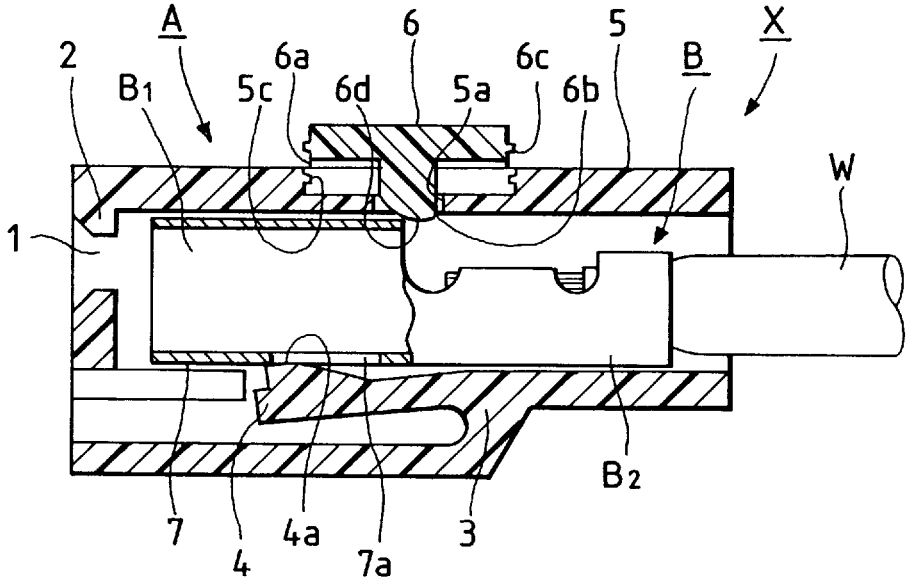
FIG. 12 PRIOR ART
FIG. 12 is a cross-sectional view showing a non-retained condition of the connector terminal in the connector of FIG. 10.

A second embodiment of a connector of the invention with a rear holder will now be described with reference to FIGS. 7 to 9. FIG. 7 is a perspective view of the connector of this embodiment with the rear holder, FIG. 8 is a cross-sectional view of a portion of the connector of FIG. 7, showing the rear holder in its provisionally-retained condition, and FIG. 9 is a cross-sectional view of a portion of the connector of FIG. 7, showing the rear holder in its completely-retained condition. This embodiment differs from the first embodiment mainly in that the rear holder is separate from a housing, and those portions of this embodiment, achieving the same effects as described above, will be designated respectively by identical reference numerals, and explanation thereof will be omitted.

As shown in FIG. 7, a first retaining portion 31*a* (31*b*) is formed on an inner surface of each of opposite side plates 15*a* and 15*b* of the housing 12A at an upper portion thereof, and a second retaining portion 32*a* (32*b*) is formed on the inner surface below this first retaining portion.

Retaining plates 33*a* and 33*b* are formed respectively at opposite ends of a rear holder upper plate 26 of the rear holder 13A. A retaining portion 34*a* (34*b*) is formed on an outer surface of each of the retaining plates 33*a* and 33*b* at an upper portion thereof, and a retaining portion 35*a* (35*b*) is formed on the outer surface below the retaining portion 34*a* (34*b*). The width of the outer surface of the retaining plate 33*a* (33*b*) is so determined that it can be inserted between the opposite side plates 15*a* and 15*b*.

For assembling the connector 11A, the rear holder 13A is first provisionally retained on the upper end portions of the opposite side plates 15*a* and 15*b* provided at the rear end portion of the housing 12A. More specifically, the rear holder upper plate 26 of the rear holder 13A is placed on the opposite side plates 15*a* and 15*b*, and then when this upper plate 26 is press down from the upper side, the retaining portion 35*a* passes past the first retaining portion 31*a* to be retained by the second or lower retaining portion 32*a*, with the retaining portion 34*a* resting on the top of the side plate 15*a*, as shown in FIG. 8. In this condition, a predetermined number of connector terminals are inserted into terminal receiving chambers 17, respectively.

Then, when the rear holder upper plate 26 is further pressed down as shown in FIG. 9, the retaining portion 34*a* is retained by the retaining portion 31*a*, thereby achieving the completely-retained condition. At this time, when the rear holder upper plate 26 is pressed down, a press member 28, formed on a lower surface of the rear holder upper plate 26, forces the connector terminals forward in the respective terminal receiving chambers 17 as in the preceding embodiment. Withdrawal prevention retaining portions 29, formed below the rear holder upper plate 26, are engaged respectively with completely- retaining portions 19, thereby retaining the connector terminals 14, and also preventing the rear holder 13A from withdrawal (see FIG. 6).

As described above, in this embodiment, also, by attaching the rear holder 13A to the housing 12A, the insertion of the connector terminals 14, as well as the prevention of withdrawal of the connector terminals 14, can be positively effected, and the operation can be effected with good efficiency.

The present invention is not to be limited to the above embodiments, and various modifications can be made. For example, in the second embodiment, 9 guide device vertically guiding the retaining plates 33*a* and 33*b*, can be provided at the outer sides of the retaining plates 33*a* and 33*b* or at the inner surfaces of the opposite side plates 15*a* and 15*b*.

As described above, in the connector of the invention with the rear holder, the rear holder includes the rear holder upper plate which is pressed when attaching the rear holder to the connector housing, and the press member formed integrally on the reverse surface of the rear holder upper plate in a suspended manner through the hinges. The press member has the withdrawal prevention retaining portions retainingly engageable respectively with the completely-retaining portions formed respectively at the upper portions of the partition walls of the connector housing.

Therefore, when the rear holder upper plate is pressed or moved toward the housing, the press member forces the connector terminals into predetermined positions in the terminal receiving chambers, and the withdrawal prevention retaining portions of the press member are retainingly engaged respectively with the completely-retaining portions formed respectively at the partition walls. Thus, by pressing the rear holder upper plate, the insertion of the connector terminals into the housing, and the attachment of the rear holder to the housing can be effected at the same time, thereby enhancing the connector assembling efficiency.

The rear holder upper plate is integrally connected to the rear end portion of the connector housing through the foldable hinges. Therefore, the rear holder upper plate, when pressed down from the upper side, is moved toward the housing, with the hinges gradually folded.

Therefore, in accordance with the movement of the rear holder upper plate, the press member slidingly moves over the partition walls in the direction of insertion of the connector terminals, so that the connector terminals can be positively inserted into the predetermined positions in the terminal receiving chambers. Therefore, the connector assembling efficiency is enhanced, and the highly-reliable connector can be obtained.

The press member is suspended in inclined relation to the direction of insertion of the connector terminals. Therefore, as the rear holder upper plate is pressed down, the press member positively slides over the partition walls in the direction of insertion of the connector terminals.

The pair of retaining plates are formed integrally on the opposite side edges of the rear holder upper plate, and each of the retaining plates has the plurality of retaining portions retainingly engageable with the rear end portion of the housing. Therefore, the housing and the rear holder can be separate from each other, and the manufacturing cost can be reduced.

The press member includes the withdrawal prevention retaining portions formed at the rear end portion thereof, and corresponding respectively to the partition walls of the connector housing, the retaining step portion formed at the front end thereof, the vertical surface formed at the front end thereof for forcing the connector terminals, and the curved surface formed at the lower side thereof for sliding movement over the partition walls.

Therefore, because of the provision of the curved surface, the press member can smoothly slide over the partition walls, and the vertical surface can abut against rear edges of electric connection portions of the connector terminals, thereby positively inserting the connector terminals, and the withdrawal prevention retaining portions can be retainingly engaged respectively with the completely-retaining portions formed respectively at the partition walls, thereby positively preventing rearward withdrawal of the connector terminals. Therefore, the mounting of the connector terminals in the respective terminal receiving chambers, and the attachment of the rear holder to the housing can be positively effected at the same time, and therefore there can be obtained the connector in which the assembling efficiency is enhanced, and the reliability is high.

What is claimed is:

1. A connector, comprising:

a connector housing having a terminal receiving chamber for receiving a terminal; and a rear holder adapted to be attached to said connector housing to retain the terminal in the terminal receiving chamber, said rear holder including an upper plate which is pressed when attaching said rear holder to said connector housing, and a press member suspended via a hinge from a lower, inwardly facing surface of the upper plate said press member adapted to retain the terminal.

2. The connector of claim 1, wherein the upper plate of said rear holder is integrally connected to a rear end portion of said connector housing through foldable hinges.

3. The connector of claim 1, wherein the press member is suspended in inclined relation to a direction of insertion of the terminal.

4. The connector of claim 1, wherein a pair of retaining plates are formed integrally on opposite side edges of the upper plate, and each of the retaining plates has a plurality of retaining portions engaged with a rear end portion of said connector housing.

5. A connector, comprising:

a connector housing having a terminal receiving chamber for receiving a terminal; and a rear holder adapted to be attached to said connector housing to retain the terminal in the terminal receiving chamber, said rear holder including an upper plate which is pressed when attaching said rear holder to said connector housing, and a press member integrally formed on a lower, inwardly facing surface of the upper plate so as to be suspended via a hinge wherein the press member includes a terminal-withdrawal prevention portion for retaining the terminal, which engages with a completely-retaining portion formed at an upper portion of a partition wall in said connector housing.

6. The connector of claim 5, wherein the upper plate of said rear holder is connected to a rear end portion of said connector housing through foldable hinges.

7. The connector of claim 5, wherein the press member is suspended in inclined relation to a direction of insertion of the terminal.

8. The connector of claim 5, wherein a pair of retaining plates are formed integrally on opposite side edges of the upper plate, and each of the retaining plates has a plurality of retaining portions engaged with a rear end portion of said connector housing.

9. The connector of claim 5, wherein the press member further includes, a retaining step portion formed at a front end thereof, a vertical surface formed at a front end thereof for forcing the terminal into said terminal receiving chamber, and a curved surface formed at a lower side thereof for sliding movement over the partition wall.

* * * * *